US012281390B2

(12) United States Patent
Inatomi et al.

(10) Patent No.: US 12,281,390 B2
(45) Date of Patent: Apr. 22, 2025

(54) SUBSTRATE LIQUID PROCESSING APPARATUS FOR SUPPLYING TEMPERATURE-CONTROLLED PLATING LIQUID

(71) Applicant: Tokyo Electron Limited, Tokyo (JP)

(72) Inventors: Yuichiro Inatomi, Kumamoto (JP); Tomonori Esaki, Kumamoto (JP)

(73) Assignee: TOKYO ELECTRON LIMITED, Tokyo (JP)

( * ) Notice: Subject to any disclaimer, the term of this patent is extended or adjusted under 35 U.S.C. 154(b) by 607 days.

(21) Appl. No.: 17/415,887

(22) PCT Filed: Dec. 16, 2019

(86) PCT No.: PCT/JP2019/049150
§ 371 (c)(1),
(2) Date: Jun. 18, 2021

(87) PCT Pub. No.: WO2020/137652
PCT Pub. Date: Jul. 2, 2020

(65) Prior Publication Data

US 2022/0074052 A1 Mar. 10, 2022

(30) Foreign Application Priority Data

Dec. 28, 2018 (JP) ..... 2018-247887

(51) Int. Cl.
*C23C 18/16* (2006.01)
*C23C 14/50* (2006.01)

(52) U.S. Cl.
CPC ..... *C23C 18/1628* (2013.01); *C23C 18/168* (2013.01)

(58) Field of Classification Search
CPC .. C23C 18/1628; C23C 18/1676; C23C 14/50
See application file for complete search history.

(56) References Cited

U.S. PATENT DOCUMENTS 5,409,310 A * 4/1995 Owczarz ..... B01F 23/49 366/160.5
5,865,894 A * 2/1999 Reynolds ..... C23C 18/1666 118/603

(Continued)

FOREIGN PATENT DOCUMENTS

CN 103314134 A 9/2013
JP S52-144894 A 12/1977

(Continued)

OTHER PUBLICATIONS

International Search Report for PCT/JP2019/049150 dated Feb. 10, 2020.

*Primary Examiner* — Karl Kurple
(74) *Attorney, Agent, or Firm* — Chrisman Gallo Tochtrop LLC

(57) ABSTRACT

A substrate liquid processing apparatus configured to supply a plating liquid to a substrate includes a substrate holder configured to hold the substrate; a plating liquid sending device configured to send the plating liquid to a first flow path; a temperature controller connected to the plating liquid sending device via the first flow path and configured to control a temperature of a fluid supplied through the first flow path; a fluid sending device configured to send a fluid different from the plating liquid to the first flow path; and a discharge device connected to the temperature controller and configured to discharge a fluid supplied from the temperature controller.

8 Claims, 8 Drawing Sheets

(56) References Cited

U.S. PATENT DOCUMENTS 6,345,642 B1 * 2/2002 Yoshidome ..... F16K 27/003 137/15.04
10,121,931 B2 * 11/2018 Orita ..... B05B 7/0458
2003/0041884 A1 * 3/2003 Bahr ..... B05B 15/55 134/22.12
2004/0194698 A1 * 10/2004 Hongo ..... H01L 21/288 257/E21.174
2006/0081461 A1 * 4/2006 Jomen ..... C23C 18/1619 204/275.1
2007/0134431 A1 * 6/2007 Hara ..... H01L 21/68728 427/443.1
2007/0266941 A1 * 11/2007 Marsh ..... C23C 16/45593 137/625.25
2010/0015791 A1 * 1/2010 Tanaka ..... C25D 17/001 118/302
2011/0143545 A1 * 6/2011 Okuchi ..... H01L 21/67017 257/E21.224
2012/0045581 A1 * 2/2012 Kimura ..... H01L 21/67051 427/256
2013/0052828 A1 * 2/2013 Hashizume ..... H01L 21/0206 438/694
2013/0247820 A1 9/2013 Orita et al.
2014/0144471 A1 * 5/2014 Kahlon ..... G01N 35/1004 134/22.12
2014/0148006 A1 * 5/2014 Tanaka ..... H01L 21/288 118/699
2015/0318183 A1 * 11/2015 Ido ..... H01L 21/67017 438/765
2018/0002811 A1 * 1/2018 Motomatsu ..... C23C 18/163
2020/0081423 A1 * 3/2020 Clark ..... H01L 21/67184

FOREIGN PATENT DOCUMENTS

JP 2000-129446 A 5/2000
JP 2004-140129 A 5/2004
JP 2006-111938 A 4/2006
JP 2009-179821 A 8/2009
JP 2018-003097 A 1/2018
WO 2012/049913 A1 4/2012

* cited by examiner

SUBSTRATE LIQUID PROCESSING APPARATUS FOR SUPPLYING TEMPERATURE-CONTROLLED PLATING LIQUID

CROSS-REFERENCE TO RELATED APPLICATIONS

This Application is a U.S. national phase application under 35 U.S.C. § 371 of PCT Application No. PCT/JP2019/049150 filed on Dec. 16, 2019, which claims the benefit of Japanese Patent Application No. 2018-247887 filed on Dec. 28, 2018, the entire disclosures of which are incorporated herein by reference.

TECHNICAL FIELD

The various aspects and exemplary embodiments described herein pertain generally to a substrate liquid processing apparatus and a substrate liquid processing method.

BACKGROUND

In a plating processing on a substrate, a plating liquid whose temperature is increased may be supplied to the substrate to improve a reactivity of the plating liquid (see Patent Document 1).

A heat exchanger may be suitably used for such temperature control of the plating liquid. For example, in an apparatus disclosed in Patent Document 2, a temperature of a plating liquid is controlled in a heat exchanger. The temperature-controlled plating liquid is pushed from the heat exchanger to a nozzle by a plating liquid, which is newly supplied to the heat exchanger, and then discharged from the nozzle toward a substrate. Meanwhile, a temperature of the plating liquid, which is newly supplied to the heat exchanger, is controlled by the heat exchanger, and after the temperature control, the plating liquid is likewise pushed from the heat exchanger to the nozzle and then discharged and supplied for a plating processing.

If the temperature of the plating liquid is controlled as such, the plating liquid is kept in a high temperature state in the heat exchanger until it is discharged from the nozzle. However, if the plating liquid is kept in a high temperature state for a long time before being discharged from the nozzle, unexpected problems such as precipitation of plating components may occur. Therefore, a reduction in the period of time during which the plating liquid is kept in a high temperature state in a temperature controller, such as the heat exchanger, before being discharged suppresses the degradation of the quality of the plating liquid and thus contributes to the improvement of the quality of the plating processing.

Patent Document 1: Japanese Patent Laid-open Publication No. 2018-003097

Patent Document 2: PCT International Publication No. WO2012/049913

SUMMARY

In one exemplary embodiment, a substrate liquid processing apparatus configured to supply a plating liquid to a substrate includes a substrate holder configured to hold the substrate; a plating liquid sending device configured to send the plating liquid to a first flow path; a temperature controller connected to the plating liquid sending device via the first flow path and configured to control a temperature of a fluid supplied through the first flow path; a fluid sending device configured to send a fluid different from the plating liquid to the first flow path; and a discharge device connected to the temperature controller and configured to discharge a fluid supplied from the temperature controller.

DETAILED DESCRIPTION

Figure 1:
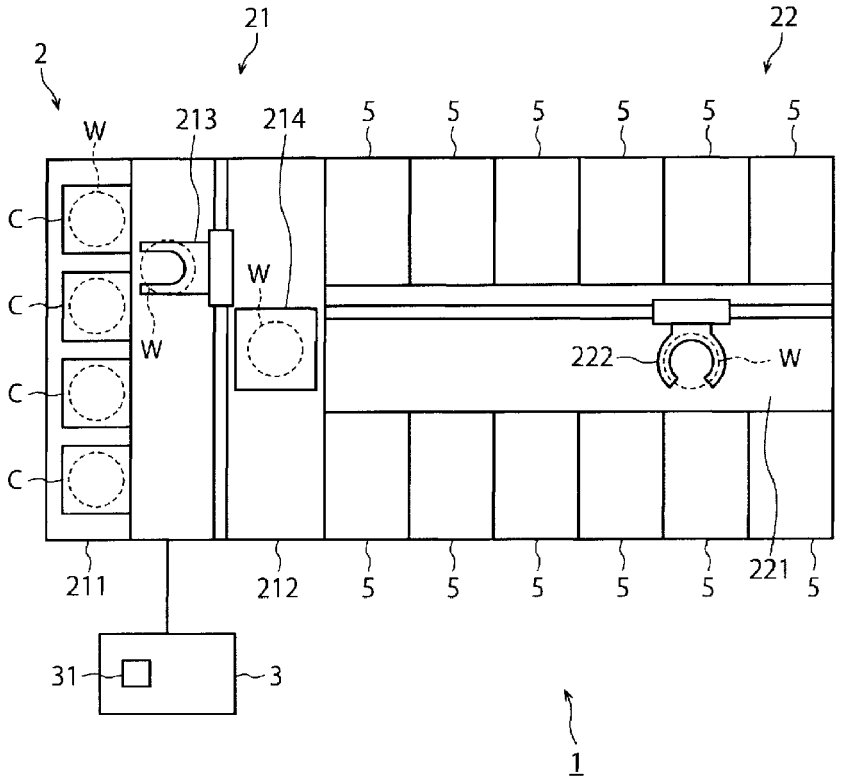
FIG. 1 is a schematic diagram showing a configuration of a plating apparatus as an example of a substrate liquid processing apparatus.

First, a configuration of a substrate liquid processing apparatus will be described with reference to FIG. 1. FIG. 1 is a schematic diagram showing a configuration of a plating apparatus as an example of the substrate liquid processing apparatus. Herein, the plating apparatus is an apparatus configured to supply a plating liquid L1 (processing liquid) to a substrate W to perform a plating (liquid processing) on the substrate W.

As shown in FIG. 1, a plating apparatus 1 includes a plating unit 2 and a controller 3 configured to control an operation of the plating unit 2.

The plating unit 2 is configured to perform various processings on the substrate (wafer) W. The processings performed by the plating unit 2 will be described later.

The controller 3 is, for example, a computer, and includes an operation controller and a storage. The operation controller is configured as, for example, a CPU (Central Processing Unit) and configured to control the operation of the plating unit 2 by reading and executing a program stored in the storage. The storage is configured as a storage device such as a RAM (Random Access Memory), a ROM (Read Only Memory) or a hard disk, and stores therein the program for controlling various processings performed in the plating unit 2. Further, the program may be recorded in a computer-readable recording medium 31, or may be installed from the recording medium 31 to the storage. The computer-readable recording medium 31 may be, for example, a hard disc (HD), a flexible disc (FD), a compact disc (CD), a magneto optical disc (MO), or a memory card. The recording medium 31 stores therein a program that, when executed by a computer for controlling an operation of the plating apparatus 1, causes the computer to control the plating apparatus 1 to perform a plating method to be described later.

The plating unit 2 is equipped with a carry-in/out station 21; and a processing station 22 provided adjacent to the carry-in/out station 21.

The carry-in/out station 21 includes a placing section 211 and a transfer section 212 provided adjacent to the placing section 211.

In the placing section 211, a plurality of transfer containers (hereinafter, referred to as "carriers C") each of which accommodates therein a plurality of substrates W horizontally is placed.

The transfer section 212 includes a transfer mechanism 213 and a delivery unit 214. The transfer mechanism 213 includes a holding mechanism configured to hold a substrate W, and is configured to be movable horizontally and vertically and pivotable around a vertical axis.

The processing station 22 includes plating devices 5. In the present exemplary embodiment, the number of plating devices 5 provided in the processing station 22 is two or more, but may be one. The plating devices 5 are arranged on both sides of a transfer path 221 which is extended in a predetermined direction (on both sides in a direction perpendicular to a moving direction of a transfer mechanism 222 to be described later).

The transfer path 221 is provided with the transfer mechanism 222. The transfer mechanism 222 includes a holding mechanism configured to hold a substrate W, and is configured to be movable horizontally and vertically and pivotable around a vertical axis.

In the plating unit 2, the transfer mechanism 213 of the carry-in/out station 21 is configured to transfer the substrate W between the carrier C and the delivery unit 214. Specifically, the transfer mechanism 213 takes out the substrate W from the carrier C placed in the placing section 211, and then, places the substrate W in the delivery unit 214. Further, the transfer mechanism 213 takes out the substrate W which is placed in the delivery unit 214 by the transfer mechanism 222 of the processing station 22, and then, accommodates the substrate W in the carrier C of the placing section 211.

In the plating unit 2, the transfer mechanism 222 of the processing station 22 is configured to transfer the substrate W between the delivery unit 214 and the plating device 5 and between the plating device 5 and the delivery unit 214. Specifically, the transfer mechanism 222 takes out the substrate W placed in the delivery unit 214 and carries the substrate W into the plating device 5. Further, the transfer mechanism 222 takes out the substrate W from the plating device 5 and places the substrate W in the delivery unit 214.

Figure 2:
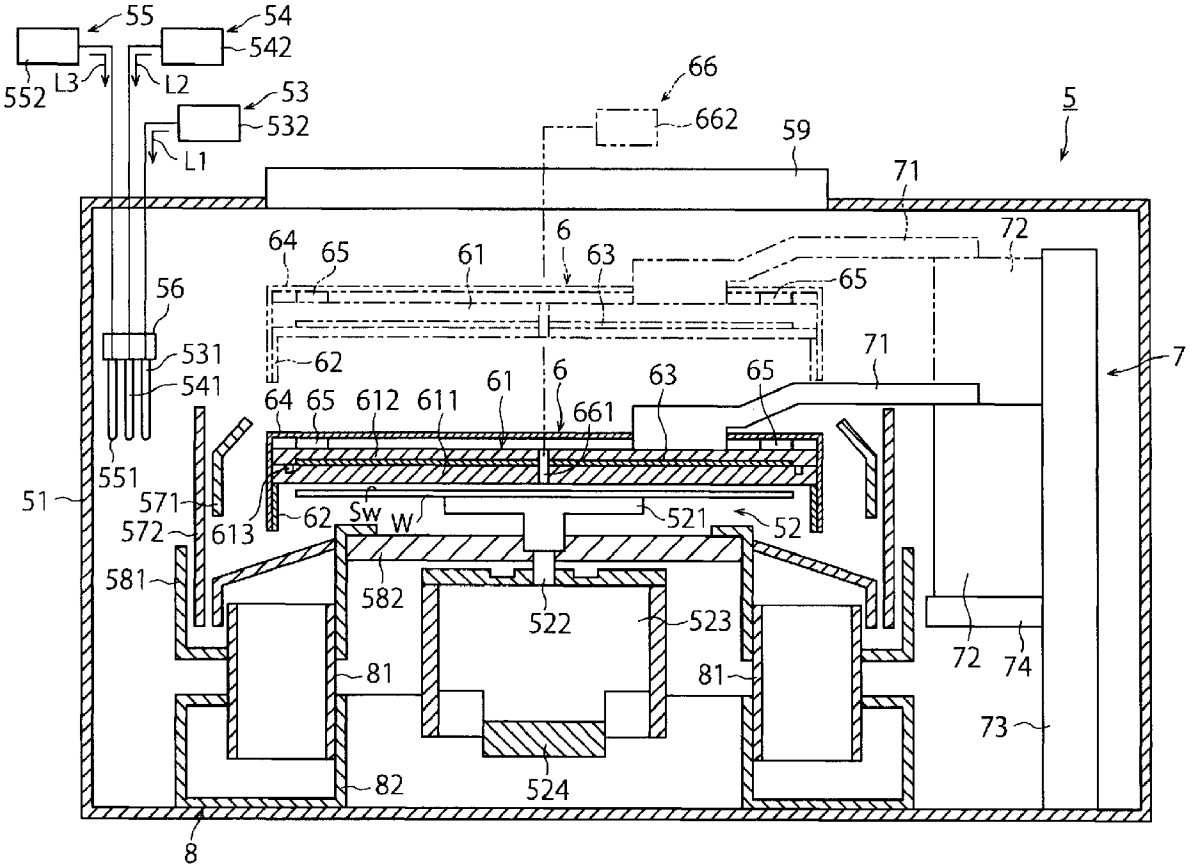
FIG. 2 is a schematic cross-sectional view showing a configuration of a plating device.

Hereinafter, a configuration of the plating device 5 will be described with reference to FIG. 2. FIG. 2 is a schematic cross-sectional view showing a configuration of the plating device 5.

The plating device 5 is configured to perform a liquid processing including an electroless plating processing. The plating device 5 is equipped with a chamber 51, a substrate holder 52 provided within the chamber 51 and configured to hold a substrate W horizontally, and a plating liquid supply 53 configured to supply a plating liquid L1 to a processing target surface (upper surface) Sw of the substrate W held by the substrate holder 52. In the present exemplary embodiment, the substrate holder 52 is equipped with a chuck member 521 configured to vacuum-attract a lower surface (rear surface) of the substrate W. The substrate holder 52 is of a so-called vacuum chuck type, but is not limited thereto. The substrate holder 52 may be of a mechanical chuck type in which an outer periphery portion of the substrate W is held by, for example, a chuck mechanism or the like.

The substrate holder 52 is connected to a rotation motor 523 (rotational driving unit) via a rotation shaft 522. When the rotation motor 523 is driven, the substrate holder 52 is rotated along with the substrate W thereon. The rotation motor 523 is supported at a base 524 fixed to the chamber 51.

The plating liquid supply 53 is equipped with a plating liquid nozzle 531 configured to discharge (supply) the plating liquid L1 onto the substrate W held by the substrate holder 52, and a plating liquid source 532 configured to supply the plating liquid L1 to the plating liquid nozzle 531. The plating liquid source 532 is configured to supply the plating liquid L1 heated to or adjusted to have a predetermined temperature to the plating liquid nozzle 531. A temperature of the plating liquid L1 when the plating liquid L1 is discharged from the plating liquid nozzle 531 is, for example, equal to or larger than 55° C. and equal to or smaller than 75° C., and more desirably, equal to or larger than 60° C. and equal to or smaller than 70° C. The plating liquid nozzle 531 is held by a nozzle arm 56 and configured to be movable.

Although not shown in FIG. 2, the plating liquid supply 53 of the present exemplary embodiment further includes a temperature controller (see reference numeral "12" in FIG. 3) configured to control the temperature of the plating liquid L1 to be sent from the plating liquid source 532 to a cleaning liquid nozzle 541 and other devices. A specific configuration example of the plating liquid supply 53 of the present exemplary embodiment will be described later.

The plating liquid L1 is an autocatalytic (reduction) plating liquid for electroless plating. The plating liquid L1 contains a metal ion such as a cobalt (Co) ion, a nickel (Ni) ion, a tungsten (W) ion, a copper (Cu) ion, a palladium (Pd) ion or a gold (Au) ion, and a reducing agent such as hypophosphorous acid or dimethylamine borane. The plating liquid L1 may further contain an additive or the like. A plating film (metal film) formed by the plating processing with the plating liquid L1 may be, for example, CoWB, CoB, CoWP, CoWBP, NiWB, NIB, NiWP, NiWBP, or the like.

The plating device 5 according to the present exemplary embodiment further includes, as other processing liquid supplies, a cleaning liquid supply 54 configured to supply a cleaning liquid L2 onto the processing target surface Sw of the substrate W held by the substrate holder 52, and a rinse liquid supply 55 configured to supply a rinse liquid L3 onto the processing target surface Sw of the substrate W.

The cleaning liquid supply 54 is equipped with a cleaning liquid nozzle 541 configured to discharge the cleaning liquid L2 onto the substrate W held by the substrate holder 52, and a cleaning liquid source 542 configured to supply the cleaning liquid L2 to the cleaning liquid nozzle 541. Examples of the cleaning liquid L2 may include an organic acid such as a formic acid, a malic acid, a succinic acid, a citric acid or a malonic acid, or a hydrofluoric acid (DHF) (aqueous solution of hydrogen fluoride) diluted to the extent that it does not corrode a plating target surface of the substrate W. The cleaning liquid nozzle 541 is held by the nozzle arm 56 and configured to be movable along with the plating liquid nozzle 531.

The rinse liquid supply 55 is equipped with a rinse liquid nozzle 551 configured to supply the rinse liquid L3 onto the substrate W held by the substrate holder 52, and a rinse liquid source 552 configured to supply the rinse liquid L3 to the rinse liquid nozzle 551. The rinse liquid nozzle 551 is held by the nozzle arm 56 and configured to be movable along with the plating liquid nozzle 531 and the cleaning liquid nozzle 541. Examples of the rinse liquid L3 may include pure water or the like.

The nozzle arm 56 holding the above-described plating liquid nozzle 531, cleaning liquid nozzle 541 and rinse liquid nozzle 551 is connected to a non-illustrated nozzle moving mechanism. The nozzle moving mechanism is configured to move the nozzle arm 56 horizontally and vertically. More specifically, the nozzle arm 56 is configured to be movable by the nozzle moving mechanism between a discharge position where the processing liquid (plating liquid L1, cleaning liquid L2 or rinse liquid L3) is discharged onto the substrate W and a retreat position retreated from the discharge position. The discharge position is not particularly limited as long as the processing liquid can be supplied onto a certain position on the processing target surface Sw of the substrate W. For example, desirably, the discharge position is set to a position where the processing liquid can be supplied to a center of the substrate W. The discharge position of the nozzle arm 56 may be set differently in the individual cases of supplying the plating liquid L1, supplying the cleaning liquid L2 and supplying the rinse liquid L3 to the substrate W. The retreat position is a position within the chamber 51 which does not overlap with the substrate W when viewed from above and is spaced apart from the discharge position. When the nozzle arm 56 is located at the retreat position, it is possible to avoid interference between a cover body 6 being moved and the nozzle arm 56.

A cup 571 is disposed around the substrate holder 52. The cup 571 is formed into a ring shape when viewed from above and configured to receive the processing liquid scattered from the substrate W when the substrate W is being rotated and configured to guide the received processing liquid to a drain duct 581 to be described later. An atmosphere blocking cover 572 is provided at an outer peripheral side of the cup 571 and configured to suppress diffusion of the ambient atmosphere around the substrate W in the chamber 51. The atmosphere blocking cover 572 is formed into a vertically extending cylindrical shape and has an open top. The cover body 6 to be descried later can be inserted into the atmosphere blocking cover 572 from above.

The drain duct 581 is provided under the cup 571. The drain duct 581 is formed into a ring shape when viewed from above, and serves to drain the processing liquid falling down after being received by the cup 571 and the processing liquid directly falling down from the vicinity of the substrate W. An inner cover 582 is provided at an inner periphery side of the drain duct 581.

The processing target surface Sw of the substrate W held by the substrate holder 52 is covered with the cover body 6. The cover body 6 has a ceiling member 61 extended horizontally, and a sidewall member 62 extended downwards from the ceiling member 61. The ceiling member 61 is located above the substrate W held by the substrate holder 52 when the cover body 6 is located at a lower position to be described later, and faces the substrate W with a relatively small gap therebetween.

The ceiling member 61 includes a first ceiling plate 611 and a second ceiling plate 612 provided on the first ceiling plate 611. A heater 63 (heating unit) is interposed between the first ceiling plate 611 and the second ceiling plate 612. The first ceiling plate 611 and the second ceiling plate 612 are respectively provided as a first planar body and a second planar body with the heater 63 interposed therebetween. The first ceiling plate 611 and the second ceiling plate 612 are configured to seal the heater 63 such that the heater 63 is not brought into contact with the processing liquid such as the plating liquid L1. More specifically, a seal ring 613 is provided at an outer peripheral side of the heater 63 between the first ceiling plate 611 and the second ceiling plate 612, and the heater 63 is sealed by the seal ring 613. Desirably, the first ceiling plate 611 and the second ceiling plate 612 have corrosion resistance against the processing liquid such as the plating liquid L1, and may be made of, for example, an aluminum alloy. Further, to improve the corrosion resistance, the first ceiling plate 611, the second ceiling plate 612 and the sidewall member 62 may be coated with Teflon (registered trademark).

The cover body 6 is connected to a cover body moving mechanism 7 via a cover body arm 71. The cover body moving mechanism 7 is configured to move the cover body 6 horizontally and vertically. More specifically, the cover body moving mechanism 7 is equipped with a rotation motor 72 configured to move the cover body 6 horizontally and a cylinder 73 (gap adjusting unit) configured to move the cover body 6 vertically. The rotation motor 72 is provided on a supporting plate 74 configured to be movable up and down with respect to the cylinder 73. Here, instead of the cylinder 73, an actuator (not shown) including a motor and a ball screw may be used.

The rotation motor 72 of the cover body moving mechanism 7 is configured to move the cover body 6 between an upper position located above the substrate W held by the substrate holder 52 and a retreat position retreated from the upper position. The upper position is a position facing the substrate W, which is held by the substrate holder 52, with a relatively large gap therebetween and overlapping with the substrate W when viewed from above. The retreat position is a position within the chamber 51 which does not overlap with the substrate W when viewed from above. When the cover body 6 is located at the retreat position, it is possible to avoid the interference between the nozzle arm 56 being moved and the cover body 6. A rotation axis of the rotation motor 72 is vertically extended, and the cover body 6 is configured to be pivotable horizontally between the upper position and the retreat position.

The cylinder 73 of the cover body moving mechanism 7 is configured to move the cover body 6 up and down and adjust the distance between the first ceiling plate 611 of the ceiling member 61 and the processing target surface Sw of the substrate W on which the plating liquid L1 is accumulated. More specifically, the cylinder 73 locates the cover body 6 at the lower position (indicated by a solid line in FIG. 2) and the upper position (indicated by a dashed double-dotted line in FIG. 2).

When the cover body 6 is placed at the lower position, the first ceiling plate 611 comes close to the substrate W. In this case, in order to suppress contamination and loss of the plating liquid L1 or to suppress generation of bubbles in the plating liquid L1, the lower position is set such that the first ceiling plate 611 is not brought into contact with the plating liquid L1 on the substrate W.

The upper position is set to a position where it is possible to avoid interference of the cover body 6 with the ambient structures such as the cup 571 and the atmosphere blocking cover 572 when the cover body 6 is pivoted horizontally.

In the present exemplary embodiment, the heater 63 is driven to generate heat. When the cover body 6 is located at the above-described lower position, the plating liquid L1 on the substrate W is heated by the heater 63.

The sidewall member 62 of the cover body 6 is extended downwards from a periphery of the first ceiling plate 611 of the ceiling member 61 and located at an outer peripheral side of the substrate W when the plating liquid L1 on the substrate W is heated (i.e., when the cover body 6 is located at the lower position). When the cover body 6 is placed at the lower position, a lower end of the sidewall member 62 may be located at a position lower than the substrate W.

The ceiling member 61 of the cover body 6 is equipped with the heater 63. The heater 63 is configured to heat a processing liquid (suitably, the plating liquid L1) on the substrate W when the cover body 6 is located at the lower position. In the present exemplary embodiment, the heater 63 is interposed between the first ceiling plate 611 and the second ceiling plate 612 of the cover body 6 and sealed as described above. Thus, the heater 63 is not brought into contact with the processing liquid such as the plating liquid L1.

In the present exemplary embodiment, an inert gas (for example, nitrogen ($N_2$) gas) is supplied to an inside of the cover body 6 by an inert gas supply 66. The inert gas supply 66 has a gas nozzle 661 configured to discharge the inert gas to the inside of the cover body 6 and an inert gas source 662 configured to supply the inert gas to the gas nozzle 661. The gas nozzle 661 is provided at the ceiling member 61 of the cover body 6 and configured to discharge the inert gas toward the substrate W in a state where the cover body 6 covers the substrate W.

The ceiling member 61 and the sidewall member 62 of the cover body 6 are covered by a cover body cover 64. The cover body cover 64 is provided on the second ceiling plate 612 of the cover body 6 with supporting members 65 therebetween. That is, a plurality of supporting members 65 protruded upwards from an upper surface of the second ceiling plate 612 is provided on the second ceiling plate 612, and the cover body cover 64 is placed on these supporting members 65. The cover body cover 64 is configured to be movable horizontally and vertically along with the cover body 6. Further, it is desirable that the cover body cover 64 has higher thermal insulation property than the ceiling member 61 and the sidewall member 62 to suppress a leakage of the heat within the cover body 6 to the vicinity thereof. For example, desirably, the cover body cover 64 may be made of a resin material. More desirably, the resin material has thermal resistance.

A fan filter unit 59 (gas supply) configured to supply clean air (gas) around the cover body 6 is provided at a top portion of the chamber 51. The fan filter unit 59 supplies air into the chamber 51 (particularly, into the atmosphere blocking cover 572), and the supplied air flows toward an exhaust line 81 to be described later. A downflow of this air is formed around the cover body 6, and a gas vaporized from the processing liquid such as the plating liquid L1 flows toward the exhaust line 81 along with this downflow. Accordingly, it is possible to suppress the rise and diffusion of the gas vaporized from the processing liquid within the chamber 51.

The gas supplied from the fan filter unit 59 is exhausted by a gas exhaust mechanism 8. The gas exhaust mechanism 8 is equipped with two exhaust lines 81 provided under the cup 571 and an exhaust duct 82 provided under the drain duct 581. The two exhaust lines 81 penetrate a bottom portion of the drain duct 581 and are individually connected to the exhaust duct 82. The exhaust duct 82 is formed into a substantially semi-circular ring shape when viewed from above. In the present exemplary embodiment, the single exhaust duct 82 is provided under the drain duct 581 and the two exhaust lines 81 communicate with this exhaust duct 82.

[Discharge of Plating Liquid]

As described above, in each plating device 5, the temperature-controlled plating liquid L1 is supplied from the plating liquid supply 53 to the substrate W. For such temperature control, a temperature of the plating liquid L1 is controlled by the temperature controller before the plating liquid L1 is discharged from the plating liquid nozzle 531. As described above, typically a new plating liquid L1 is supplied to the temperature controller to push the temperature-controlled plating liquid L1 from the temperature controller and discharge the temperature-controlled plating liquid L1 from the plating liquid nozzle 531. In this case, the plating liquid L1 newly supplied to the temperature controller stays to be heated in the temperature controller until a next plating processing. Therefore, the plating liquid L1 staying in the temperature controller is continuously heated and kept in a high temperature state until the next plating processing is started after the current plating processing is completed.

If a length of time in which the plating liquid is kept in a high temperature state in the temperature controller increases, plating components are precipitated from the plating liquid. The plating components precipitated in the temperature controller are not desirable because they form particles in the plating processing. It is not easy to remove the plating components from the temperature controller, and it is necessary to drain the plating components from the temperature controller by using pure water (i.e., DIW) or clean the temperature controller by using a liquid (for example, acidic liquid such as SPM) configured to dissolve the plating components. Here, the DIW is also referred to as de-ionized water. Further, the SPM (sulfuric hydrogen peroxide mixture) is a mixed solution of sulfuric acid ($H_2SO_4$), hydrogen peroxide ($H_2O_2$) and water ($H_2O$).

The relationship among the temperature of the plating liquid L1, the temperature-keeping time and the precipitation of the plating components varies depending on the composition of the plating liquid, but as the length of time in which the plating liquid is kept in a high temperature state increases, the precipitation of the plating components tends to be more prominent. The present inventors observes a tendency of the precipitation of the plating components under various conditions. As a result, in some of the commonly used plating liquids, the precipitation of the plating components tends to be more prominent as the temperature-keeping time increased beyond about 30 minutes. Therefore, if each plating processing is performed for a long time (for example, 30 minutes or more), the plating liquid inside the temperature controller is thus kept in a high temperature state for a long time, so that the possibility of the precipitation of the plating components in the temperature controller greatly increases. As a method of reducing the precipitation of the plating components in the temperature controller, strict management of a heating time and a heating temperature of the plating liquid L1 in the temperature controller is been considered. However, such management is troublesome and is not simple.

Meanwhile, in the plating liquid supply 53 according to the present exemplary embodiment described below, a fluid different from the plating liquid L1 is supplied into the temperature controlled in order to push the plating liquid L1 from the temperature controller to the plating liquid nozzle 531. Thus, it is possible to suppress the plating liquid L1 from being kept in a high temperature state for a long time in the temperature controller and thus suppress the plating components from being precipitated in the temperature controller.

Figure 3:
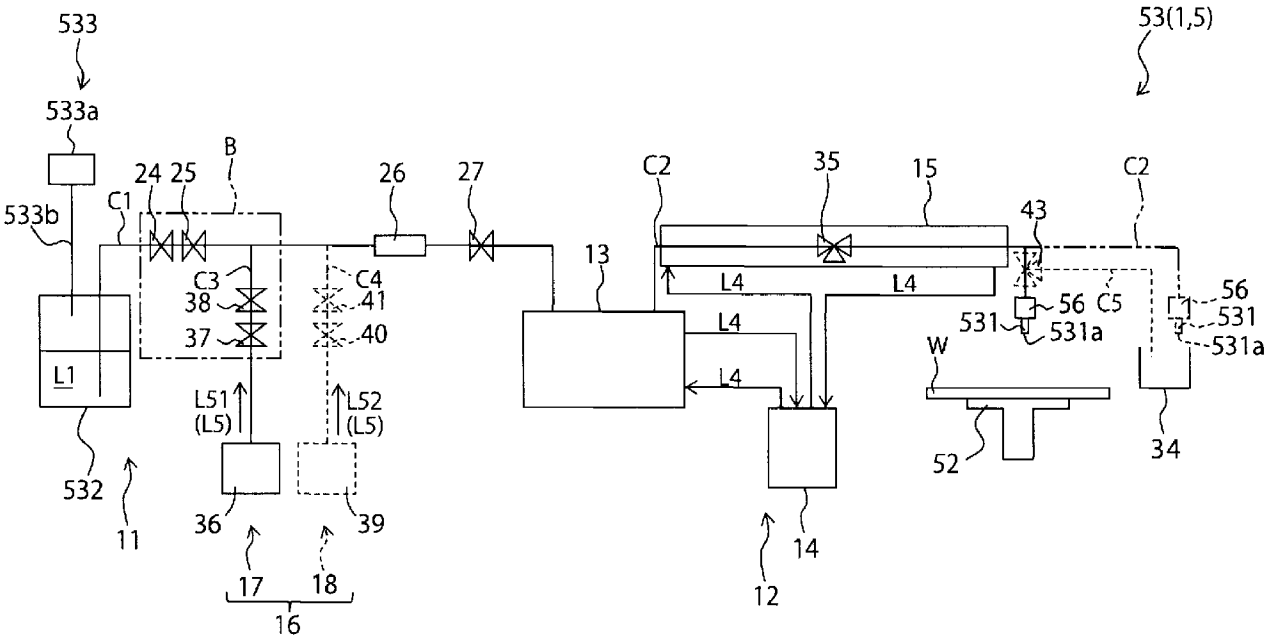
FIG. 3 is a block diagram showing an exemplary configuration of a plating liquid supply.

FIG. 3 is a block diagram showing an exemplary configuration of the plating liquid supply 53. The specific configuration of each block shown in FIG. 3 is not limited, and each block shown in FIG. 3 can be configured by any single device or a combination of a plurality of devices.

The plating liquid supply 53 is equipped with a plating liquid sending device 11, a temperature controller 12 connected to the plating liquid sending device 11 via a first flow path C1, and the plating liquid nozzle (discharge device) 531 connected to the temperature controller 12 via a second flow path C2.

The plating liquid sending device 11 is configured to send the plating liquid L1 to the first flow path C1 under the control of the controller 3 (see FIG. 1). The illustrated plating liquid sending device 11 is equipped with the plating liquid source 532 connected to the first flow path C1 and a plating liquid sending mechanism 533 connected to the plating liquid source 532. The plating liquid source 532 is configured as a plating liquid tank that stores a large amount of the plating liquid L1. The plating liquid sending mechanism 533 is configured to send the plating liquid L1 from the plating liquid source 532 toward the first flow path C1 by applying a pressure to the plating liquid L1 stored in the plating liquid source 532. The plating liquid sending mechanism 533 may include a pump or the like. The illustrated plating liquid sending mechanism 533 includes a gas sending unit 533*a* configured to send a delivery gas (for example, inert gas such as $N_2$) under the control of the controller 3, and a gas channel 533*b* configured to guide the delivery gas from the gas sending unit 533*a* to the plating liquid source 532.

In the illustrated first flow path C1, a first plating liquid opening/closing valve 24, a plating liquid constant pressure valve 25, a flowmeter 26 and a second plating liquid opening/closing valve 27 are provided in sequence from the plating liquid sending device 11 toward the temperature controller 12.

The first plating liquid opening/closing valve 24 is configured to open and close the first flow path C1 and adjust a flow rate of a fluid (particularly, the plating liquid L1) in the first flow path C1 under the control of the controller 3. The plating liquid L1 inside the first flow path C1 flows from the plating liquid source 532 toward a heat exchanger 13 through the first plating liquid opening/closing valve 24 in an open state, or is blocked by the first plating liquid opening/closing valve 24 in a closed state. The plating liquid constant pressure valve 25 is configured to adjust a pressure of the plating liquid L1 inside the first flow path C1 flowing toward the temperature controller 12, and the plating liquid L1 having a desired pressure is sent toward the heat exchanger 13 through the plating liquid constant pressure valve 25. The flowmeter 26 is configured to measure a flow rate of a fluid (particularly, a liquid, such as the plating liquid L1 or a liquid L51, to be described later) flowing in the first flow path C1. The measurement result of the flowmeter 26 is output to the controller 3.

The second plating liquid opening/closing valve 27 is configured to open and close the first flow path C1 and adjusts flow rates of fluids (particularly, the plating liquid L1 and a fluid L5) in the first flow path C1 under the control of the controller 3. The fluids inside the first flow path C1 flow toward the heat exchanger 13 through the second plating liquid opening/closing valve 27 in an open state or are blocked by the second plating liquid opening/closing valve 27 in a closed state. The opening and closing timing of the second plating liquid opening/closing valve 27 is not limited. For example, it is possible to suppress a sudden sending of the plating liquid L1 to the heat exchanger 13 by setting the opening timing of the second plating liquid opening/closing valve 27 later than the opening timing of the first plating liquid opening/closing valve 24. The second plating liquid opening/closing valve 27 may not be provided. In this case, the supply of the plating liquid L1 from the plating liquid source 532 to the heat exchanger 13 may be adjusted by the first plating liquid opening/closing valve 24. Also, the supply of the liquid L51 from a liquid sending unit 36 to be described later to the heat exchanger 13 may be adjusted by a liquid opening/closing valve 37.

The temperature controller 12 controls a temperature of the fluid supplied through the first flow path C1. The temperature controller 12 is provided to mainly heat the plating liquid L1, but actually may also heat other fluids supplied into the temperature controller 12. The temperature controller 12 according to the present exemplary embodiment heats the plating liquid L1 being sent from the plating liquid source 532 and the fluid L5 being sent from a fluid sending device 16. The temperature controller 12 may have an arbitrary configuration, and for example, a device described in Patent Document 2 may be applied thereto. The illustrated temperature controller 12 is equipped with the heat exchanger 13, a heat transfer medium supply 14 and a temperature-keeping unit 15.

The heat exchanger 13 is connected to the first flow path C1 and the second flow path C2, and various fluids are supplied into the heat exchanger 13 through the first flow path C1 and various fluids are discharged from the heat exchanger 13 through the second flow path C2. The heat exchanger 13 is configured to control a temperature of the plating liquid L1 supplied through the first flow path C1 by using heat from a heat transfer medium L4 supplied from the heat transfer medium supply 14. While the plating liquid L1 stays in a flow path (for example, a spiral passageway) of the heat exchanger 13, the plating liquid L1 is heated through heat exchange with the heat transfer medium L4. Then, the plating liquid L1 is sent from the heat exchanger 13 to the second flow path C2.

The temperature-keeping unit 15 is provided in the second flow path C2 and is configured to adjust a temperature of a fluid (for example, the plating liquid L1) inside the second flow path C2 by using heat from the heat transfer medium L4 supplied from the heat transfer medium supply 14. The temperature-keeping unit 15 is provided partially or entirely in the second flow path C2. A portion of the second flow path C2 where the temperature-keeping unit 15 is provided serves as a part of the temperature controller 12. The temperature-keeping unit 15 of the present exemplary embodiment keeps the temperature of the plating liquid L1 inside the second flow path C2 in order not to decrease the temperature of the plating liquid L1 whose temperature has increased in the heat exchanger 13, or may heat the plating liquid L1 inside the second flow path C2 in order to actively increase the temperature of the plating liquid L1.

The heat transfer medium supply 14 is configured to supply and recover the heat transfer medium L4 to and from each of the heat exchanger 13 and the temperature-keeping unit 15. Typically, a circulation flow path is formed between the heat transfer medium supply 14 and the heat exchanger 13 and a circulation flow path is formed between the heat transfer medium supply 14 and the temperature-keeping unit 15, and the heat transfer medium supply 14 allows the heat transfer medium L4 to these circulation flow paths. The heat transfer medium L4 having a desired temperature is supplied from the heat transfer medium supply 14 to each of the heat exchanger 13 and the temperature-keeping unit 15. The heat transfer medium L4 whose temperature has decreased in each of the heat exchanger 13 and the temperature-keeping unit 15 is returned to the heat transfer medium supply 14 and then heated by the heat transfer medium supply 14 to be adjusted to a desired temperature. The heat transfer medium L4 whose temperature has been adjusted to a desired temperature is supplied again to each of the heat exchanger 13 and the temperature-keeping unit 15. Further, the temperature of the heat transfer medium L4 supplied from the heat transfer medium supply 14 to the heat exchanger 13 may be identical to or different from the temperature of the heat transfer medium L4 supplied from the heat transfer medium supply 14 to the temperature-keeping unit 15.

The plating liquid nozzle 531 has an opening 531*a* through which a fluid can be discharged and is connected to the heat exchanger 13 of the temperature controller 12 through the second flow path C2 to discharge the fluid supplied through the second flow path C2 from the opening 531*a*. The plating liquid nozzle 531 of the present exemplary embodiment discharges the plating liquid L1, which is sent from the heat exchanger 13 through the second flow path C2, from the opening 531*a* as the fluid L5 is sent from the fluid sending device 16 to the first flow path C1.

As described above, the plating liquid nozzle 531 is configured to be movable by the nozzle arm 56 and can be located at the discharge position (see the solid line in FIG. 3) and the retreat position (see the dashed double-dotted line in FIG. 3 and FIG. 2). The discharge position is a position for supplying the plating liquid L1 from the plating liquid nozzle 531 to the substrate W, and the opening 531*a* of the plating liquid nozzle 531 located at the discharge position faces the substrate W held by the substrate holder 52. The retreat position is a position for avoiding interference in a processing, and the opening 531*a* of the plating liquid nozzle 531 located at the retreat position does not face the substrate W held by the substrate holder 52. The plating liquid nozzle 531 at the retreat position may discharge the fluid L5 or other unnecessary liquids toward a drain port 34 located at a position facing the opening 531*a*. Thus, it is possible to drain the unnecessary liquid from the second flow path C2.

Also, the fluid inside the second flow path C2 that connects the temperature controller 12 to the plating liquid nozzle 531 may be drained by another method. For example, as indicated by the dotted line in FIG. 3, the fluid inside the second flow path C2 can be drained through a fifth flow path (drain flow path) C5 connected to the second flow path C2 via a drain switching valve 43. The drain switching valve 43 is put in a non-drain state and a drain state under the control of the controller 3. The drain switching valve 43 in the non-drain state blocks between the second flow path C2 and the fifth flow path C5 and allows the fluid flowing toward the plating liquid nozzle 531 to pass through. The drain switching valve 43 in the drain state blocks the second flow path C2 and connects the second flow path C2 to the fifth flow path C5 to guide the fluid from the second flow path C2 to the fifth flow path C5. The fluid (particularly, liquid) guided to the fifth flow path C5 is drained to the drain port 34.

A drain unit 35 configured by an opening/closing device, such as a three-way valve, is provided in the illustrated second flow path C2. After the discharge of the plating liquid L1 is ended, the plating liquid L1 remaining in the second flow path C2 may unintentionally drip down from the plating liquid nozzle 531 due to thermal expansion. Particularly, when the second flow path C2 is heated by the temperature-keeping unit 15, a liquid is likely to drip down from the plating liquid nozzle 531. In the present exemplary embodiment, the drain unit 35 is opened after the discharge of the plating liquid L1 is ended under the control of the controller 3, and, thus, the plating liquid L1 remaining inside the second flow path C2 is drained by its own weight from the second flow path C2 through the drain unit 35. Accordingly, the liquid remaining inside the second flow path C2 is pulled toward the drain unit 35, and, thus, it is possible to effectively suppress the liquid drop from the plating liquid nozzle 531. Also, the drain unit 35 in a closed state blocks between an inside and an outside of the second flow path C2 to allow the fluid flowing inside the second flow path C2 to pass through.

The fluid sending device 16 is configured to send the fluid L5 different from the plating liquid L1 to the first flow path C1. The fluid L5 may be any one of a gas and a liquid. In the illustrated example, the liquid L51 is used as the fluid L5. Desirably, the liquid L51 is a liquid that does not cause a problem (for example, a liquid that does not generate particles) even when heated by the temperature controller 12. Further, if the liquid L51 can be brought into contact with the plating liquid L1 in the plating liquid supply 53, the liquid L51 may be desirably a liquid that does not greatly change the composition of the plating liquid L1 even when mixed with the plating liquid L1. As the liquid L51, pure water or a liquid included in the plating liquid L1 may be suitably used. Further, when it is expected that the first flow path C1, the heat exchanger 13 or the second flow path C2 is cleaned by the liquid L51, a liquid (for example, acidic liquid such as SPM) suitable for such cleaning may be used as the liquid L51.

The illustrated fluid sending device 16 is equipped with a liquid supply 17 configured to send the liquid L51 to the first flow path C1. The liquid supply 17 is equipped with the liquid sending unit 36 connected to the first flow path C1 via a third flow path C3, and the liquid opening/closing valve 37 and a liquid constant pressure valve 38 provided in the third flow path C3.

The liquid sending unit 36 sends the liquid L51 to the third flow path C3 under the control of the controller 3. Although not shown in the drawings, a reservoir configured to store the liquid L51, a sending unit, such as a pump, configured to send the liquid L51 from the reservoir to the third flow path C3 and a valve configured to adjust the amount of the liquid L51 to be sent from the reservoir to the third flow path C3 may be included in the liquid sending unit 36.

The liquid opening/closing valve 37 is configured to open and close the third flow path C3 to adjust a flow rate of the liquid L51 in the third flow path C3 under the control of the controller 3. The liquid L51 inside the third flow path C3 flows from the liquid sending unit 36 toward the first flow path C1 through the liquid opening/closing valve 37 in an open state, or is blocked by the liquid opening/closing valve 37 in a closed state. The liquid constant pressure valve 38 is configured to adjust a pressure of the liquid L51 inside the third flow path C3 flowing toward the first flow path C1, and the liquid L51 having a predetermined pressure is supplied from the third flow path C3 into the first flow path C1 through the liquid constant pressure valve 38.

The third flow path C3 may be connected to the first flow path C1 at any position between the plating liquid source 532 and the heat exchanger 13. In the illustrated example, the third flow path C3 is connected to the first flow path C1 at a position between the plating liquid constant pressure valve 25 and the flowmeter 26, or may be connected to the first flow path C1 at another position. For example, the third flow path C3 may be connected to the first flow path C1 at a position close to the heat exchanger 13 (for example, a position between the second plating liquid opening/closing valve 27 and the heat exchanger 13). By bringing a connection point of the third flow path C3 to the first flow path C1 closer to the heat exchanger 13, it is possible to reduce the amount of the plating liquid L1 to be drained when the liquid L51 flows to the first flow path C1.

The fluid L5 may include a gas L52 instead of or in addition to the liquid L51. Desirably, the gas L52 is a gas that does not cause a problem (for example, a gas that does not generate particles) even when heated by the temperature controller 12. Further, if the gas L52 can be brought into contact with the plating liquid L1 in the plating liquid supply 53, the gas L52 may be desirably a gas that does not greatly change the composition of the plating liquid L1 even when mixed with the plating liquid L1. For example, an inert gas, such as $N_2$, can be suitably used as the gas L52.

The fluid sending device 16 may be equipped with, instead of or in addition to the above-described liquid supply 17, a gas supply 18 configured to send the gas L52 to the first flow path C1. The illustrated gas supply 18 is equipped with a gas sending unit 39 connected to the first flow path C1 via a fourth flow path C4, and a gas opening/closing valve 40 and a gas constant pressure valve 41 provided in the fourth flow path C4.

The gas sending unit 39 is configured to send the gas L52 to the fourth flow path C4 under the control of the controller 3. Although not shown in the drawings, for example, a reservoir configured to store the gas L52, a sending unit, such as a pump, configured to send the gas L52 from the reservoir to the fourth flow path C4 and a valve configured to adjust the amount of the gas L52 to be sent from the reservoir to the third flow path C3 may be included in the gas sending unit 39.

The gas opening/closing valve 40 is configured to open and close the fourth flow path C4 to adjust a flow rate of the gas L52 in the fourth flow path C4 under the control of the controller 3. The gas L52 inside the fourth flow path C4 flows from the gas sending unit 39 toward the first flow path C1 through the gas opening/closing valve 40 in an open state, or is blocked by the gas opening/closing valve 40 in a closed state. The gas constant pressure valve 41 is configured to adjust a pressure of the gas L52 inside the fourth flow path C4 flowing toward the first flow path C1, and the gas L52 having a predetermined pressure is supplied from the fourth flow path C4 into the first flow path C1 through the gas constant pressure valve 41.

The fourth flow path C4 may be connected to the first flow path C1 at any position between the plating liquid source 532 and the heat exchanger 13. In the illustrated example, the fourth flow path C4 is connected to the first flow path C1 at a position between the plating liquid constant pressure valve 25 and the flowmeter 26, or may be connected to the first flow path C1 at another position. For example, the fourth flow path C4 may be connected to the first flow path C1 at a position close to the heat exchanger 13 (for example, a position between the second plating liquid opening/closing valve 27 and the heat exchanger 13) of the temperature controller 12. A connection point of the fourth flow path C4 to the first flow path C1 may be located on an upstream side (i.e., the plating liquid source 532 side) or a downstream side (i.e., the heat exchanger 13 side) of the connection point of the third flow path C3 to the first flow path C1, or may be identical to the connection point of the third flow path C3 to the first flow path C1.

If both the liquid L51 and the gas L52 are used as the fluid L5, the gas L52 may be interposed between the plating liquid L1 and the liquid L51 inside the flow path of the plating liquid supply 53. For example, the heat exchanger 13 of the temperature controller 12 may be supplied with the gas L52 through the first flow path C1 after the plating liquid L1 is supplied through the first flow path C1, and supplied with the liquid L51 through the first flow path C1 after the gas L52 is supplied through the first flow path C1. In this case, the gas L52 interposed between the plating liquid L1 and the liquid L51 suppresses contact and mixing between the plating liquid L1 and the liquid L51. By suppressing the mixing between the plating liquid L1 and the liquid L51, it is possible to more effectively use the plating liquid L1. For example, most of the plating liquid L1 inside the flow path can be discharged from the plating liquid nozzle 531 onto the substrate W and supplied for a plating processing.

Each of the above-described devices constituting the plating liquid supply 53 can be controlled by the controller 3 (see FIG. 1). For example, the controller 3 controls the plating liquid sending mechanism 533, the first plating liquid opening/closing valve 24 and the second plating liquid opening/closing valve 27 to send the plating liquid L1 from the plating liquid source 532 to the heat exchanger 13 at a desired timing. Also, the controller 3 controls the liquid sending unit 36, the liquid opening/closing valve 37 and the second plating liquid opening/closing valve 27 to send the liquid L51 from the liquid sending unit 36 to the heat exchanger 13 through the third flow path C3 and the first flow path C1 at a desired timing. Further, the controller 3 can control the gas sending unit 39, the gas opening/closing valve 40 and the second plating liquid opening/closing valve 27 to send the gas L52 from the gas sending unit 39 to the heat exchanger 13 through the fourth flow path C4 and the first flow path C1 at a desired timing.

The controller 3 may control the plating liquid sending device 11 and the fluid sending device 16, such that a timing of sending the plating liquid L1 from the plating liquid sending device 11 to the first flow path C1 is different from a timing of sending the fluid L5 from the fluid sending device 16 to the first flow path C1. Specifically, the fluid L5 may be sent toward the temperature controller 12 through the first flow path C1 after the plating liquid L1 is sent toward the temperature controller 12 through the first flow path C1, and the plating liquid L1 heated to a desired temperature in the temperature controller 12 is pushed by the fluid L5. Thus, after the heat exchanger 13 sends the plating liquid L1 toward the plating liquid nozzle 531, the heat exchanger 13 is filled with the liquid L51. Therefore, even if the time required to complete the plating processing being performed increases, the precipitation of the plating components does not occur in the heat exchanger 13 filled with the liquid L51.

[Plating Method]

Hereinafter, the overall flow of the plating method performed by the plating device 5 will be described first, and then a discharge flow of the plating liquid will be described. An operation of the plating device 5 to be described below is controlled by the controller 3. Further, while the following processing is being performed, the clean air is supplied into the chamber 51 from the fan filter unit 59 and the air within the chamber 51 flows toward the exhaust line 81.

Figure 4:
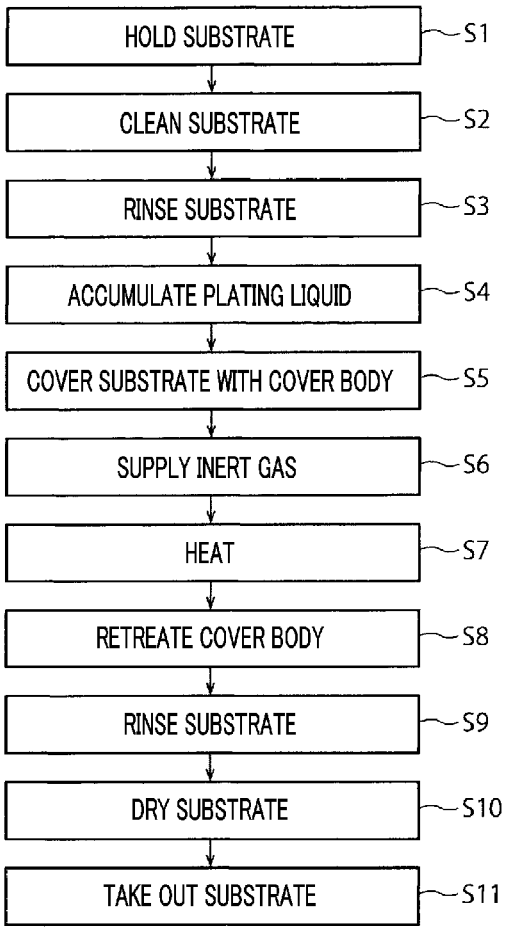
FIG. 4 is a flowchart showing an example of a plating method.

FIG. 4 is a flowchart showing an example of a plating method.

First, the substrate W is carried into the plating device 5 and is horizontally held by the substrate holder 52 (S1 shown in FIG. 4). Then, a cleaning processing is performed on the substrate W held by the substrate holder 52 (S2). In this cleaning processing, the rotation motor 523 is first driven to rotate the substrate W at a predetermined rotational speed. Subsequently, the nozzle arm 56 located at the retreat position is moved to the discharge position, and the cleaning liquid L2 is supplied from the cleaning liquid nozzle 541 onto the processing target surface Sw of the substrate W being rotated. The cleaning liquid L2 is drained into the drain duct 581.

Subsequently, a rinsing processing is performed by supplying the rinse liquid L3 from the rinse liquid nozzle 551 onto the substrate W being rotated (S3). Thus, the cleaning liquid L2 remaining on the substrate W is washed away by the rinse liquid L3, and the rinse liquid L3 is drained into the drain duct 581. Thereafter, a plating liquid accumulating process in which the plating liquid L1 is supplied onto the processing target surface Sw of the substrate W held by the substrate holder 52 to form the puddle of the plating liquid L1 on the processing target surface Sw of the substrate W is performed (S4). The plating liquid L1 stays on the processing target surface Sw due to the surface tension, and the puddle of the plating liquid L1 is formed. The plating liquid L1 flows off the processing target surface Sw to be drained through the drain duct 581. After a predetermined amount of the plating liquid L1 is discharged from the plating liquid nozzle 531, the discharge of the plating liquid L1 is stopped. Then, the plating liquid nozzle 531 with the nozzle arm 56 is returned back to the retreat position.

Then, as a plating liquid heating process, the plating liquid L1 accumulated on the substrate W is heated. This plating liquid heating process includes a process of covering the substrate W with the cover body 6 (S5), a process of supplying the inert gas (S6), a heating process of placing the cover body 6 at the lower position and heating the plating liquid L1 (S7) and a process of retreating the cover body 6 from above the substrate W (S8). Subsequently, a rinsing processing is performed on the substrate W (S9). The rinse liquid L3 is supplied from the rinse liquid nozzle 551 onto the substrate W being rotated, so that the plating liquid L1 remaining on the substrate W is washed away. Thereafter, a drying processing is performed on the substrate W (S10). The substrate W is rotated at a high speed, so that the rinse liquid L3 remaining on the substrate W is removed and the substrate W with a plating film thereon is obtained. Then, the substrate W is taken out from the substrate holder 52 and carried out from the plating device 5 (S11).

FIG. 5A to FIG. 5D are schematic diagrams of the plating liquid supply 53 to show the discharge flow of the plating liquid L1. In FIG. 5A to FIG. 5D, for easy understanding, illustration of some components (for example, illustration of the temperature-keeping unit 15 and the like) will be omitted.

Figure 5A:
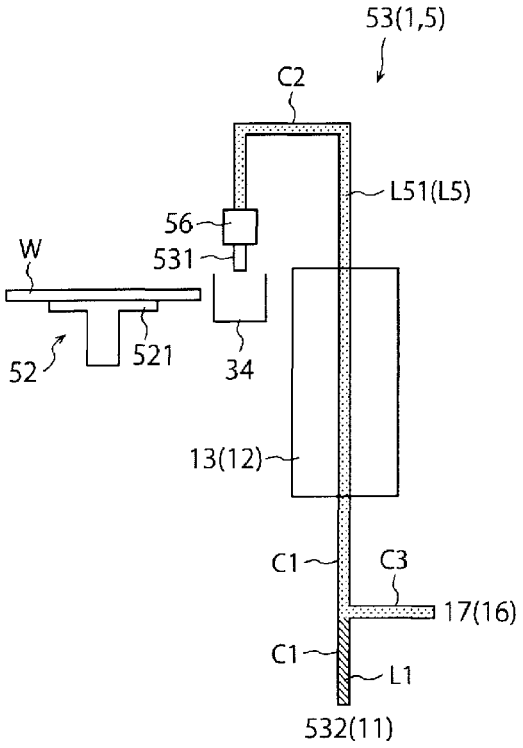
FIG. 5A is a schematic diagram of the plating liquid supply to show a discharge flow of a plating liquid.

In the plating method (substrate liquid processing method) of supplying the plating liquid to the substrate W, the plating liquid supply 53 of the present exemplary embodiment is put in a state as shown in FIG. 5A during idle time. That is, the liquid L51 is supplied from the liquid supply 17 to the first flow path C1 through the third flow path C3, and the flow path of the heat exchanger 13 and the second flow path C2 are filled with the liquid L51. Here, by controlling the supply of the liquid L51 from the liquid supply 17 to the first flow path C1, the plating liquid nozzle 531 may not discharge the liquid L51 or may continuously or intermittently discharge the liquid L51 toward the drain port 34. It is desirable to basically locate the plating liquid nozzle 531 at the retreat position during the idle time, but the plating liquid nozzle 531 may be located at another position if necessary. Particularly, if the plating liquid nozzle 531 is configured as one body with other nozzles (the cleaning liquid nozzle 541 and the rinse liquid nozzle 551 (see FIG. 3)) as described in the present example, the plating liquid nozzle 531 moves together with the other nozzles depending on whether it is necessary to move the other nozzles. Meanwhile, by stopping the operation of the plating liquid sending mechanism 533 or closing the first plating liquid opening/closing valve 24 shown in FIG. 3, the plating liquid L1 is not newly supplied from the plating liquid source 532 to the first flow path C1. For this reason, as shown in FIG. 5A, the plating liquid L1 is present only on the upstream side of the connection point with the third flow path C3 in the first flow path C1.

Figure 5B:
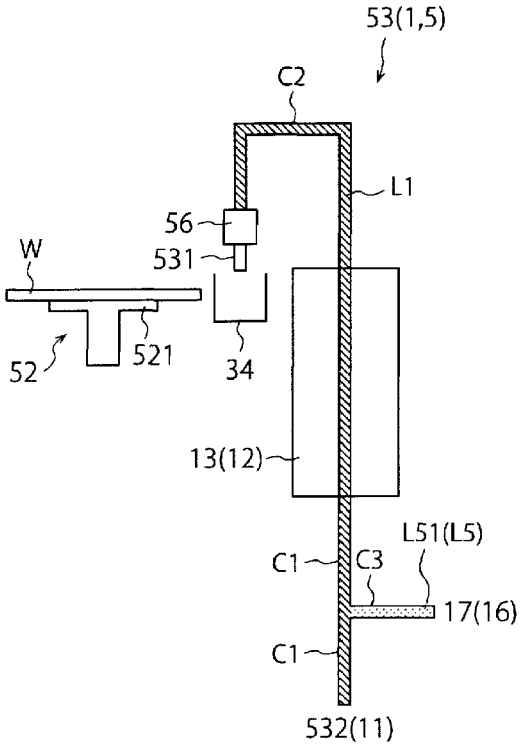
FIG. 5B is a schematic diagram of the plating liquid supply to show the discharge flow of the plating liquid.

Then, before (desirably, immediately before) the plating liquid L1 is discharged from the plating liquid nozzle 531, the plating liquid supply 53 adjusts the temperature of the plating liquid L1 as shown in FIG. 5B. That is, a process of sending the plating liquid L1 from the plating liquid sending device 11 to the temperature controller 12 through the first flow path C1 and a process of controlling the temperature of the plating liquid L1 supplied through the first flow path C1 by the temperature controller 12 are performed. Specifically, the flow path of the heat exchanger 13 and the second flow path C2 are filled with the plating liquid L1 supplied from the plating liquid source 532, and the temperature of the plating liquid L1 inside the heat exchanger 13 and the second flow path C2 is controlled by the heat exchanger 13 and the temperature-keeping unit 15 (see FIG. 3). Here, the liquid L51 (see FIG. 5A) inside the first flow path C1, the heat exchanger 13 and the second flow path C2 is pushed by the plating liquid L1 to be drained from the plating liquid nozzle 531 to the drain port 34. The liquid L51 may be drained from the second flow path C2 to the drain port 34 through the drain switching valve 43 and the fifth flow path C5 (see FIG. 3).

Figure 5C:
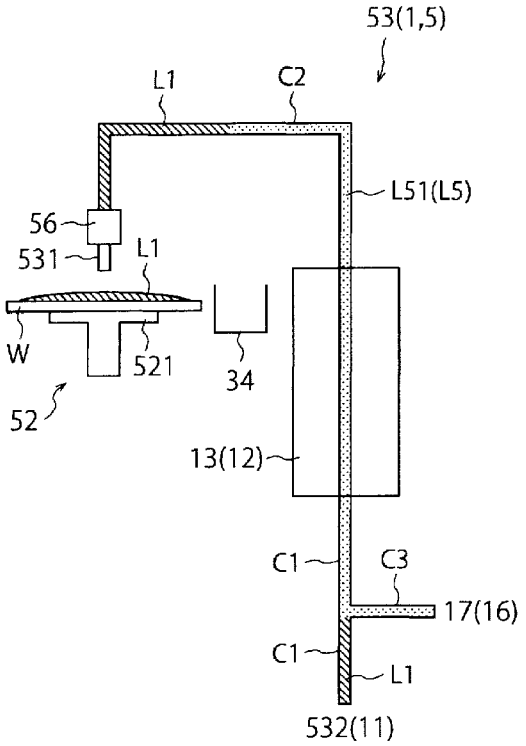
FIG. 5C is a schematic diagram of the plating liquid supply to show the discharge flow of the plating liquid.

Then, after the plating liquid L1 inside the heat exchanger 13 and the second flow path C2 is sufficiently heated and adjusted in temperature, the plating liquid supply 53 discharges the plating liquid L1 onto the substrate W as shown in FIG. 5C. That is, in a state where the plating liquid nozzle 531 is located at the discharge position, the liquid L51 (the fluid L5) is sent from the liquid supply 17 (the fluid sending device 16) to the heat exchanger 13 (the temperature controller 12) and the second flow path C2 through the first flow path C1. Accordingly, the plating liquid L1 is sent from the heat exchanger 13 and the second flow path C2 toward the plating liquid nozzle 531 to be discharged from the plating liquid nozzle 531 toward the substrate W.

Figure 5D:
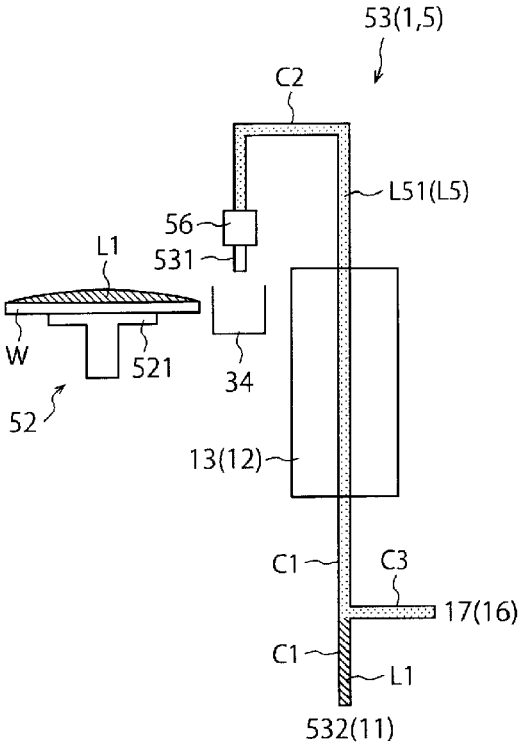
FIG. 5D is a schematic diagram of the plating liquid supply to show the discharge flow of the plating liquid.

After a sufficient amount of the plating liquid L1 is discharged onto the substrate W, the plating liquid supply 53 fills the flow path of the heat exchanger 13 and the second flow path C2 with the liquid L51 as shown in FIG. 5D. In a state where the plating liquid L1 is allowed to remain in the second flow path C2, it is desirable to drain the liquid L51 together with the remaining plating liquid L1 from the second flow path C2 to the drain port 34 in view of ensuring that only the plating liquid L1 is discharged onto the substrate W. In the example shown in FIG. 5D, the plating liquid L1 remaining in the second flow path C2 is drained together with the liquid L51 from the plating liquid nozzle 531 located at the retreat position toward the drain port 34. Here, the plating liquid L1 remaining in the second flow path C2 may be drained together with the liquid L51 to the drain port 34 through the drain switching valve 43 and the fifth flow path C5 (see FIG. 3).

Then, the plating liquid supply 53 returns back to the idle state (see FIG. 5A). In view of the processes S1 to S11 shown in FIG. 4, the plating liquid supply 53 may be put in the idle state (FIG. 5A) in the processes except the plating liquid accumulating process S4 (i.e., S1 to S3 and S5 to S11). Further, in the plating liquid accumulating process S4, the plating liquid L1 and the liquid L51 may be sent to the first flow path C1, the heat exchanger 13 and the second flow path C2 as shown in FIG. 5B to FIG. 5D. Here, a processing before the plating liquid L1 is supplied to the substrate W (see FIG. 5A and FIG. 5B) and a processing after the plating liquid L1 is supplied to the substrate W (see FIG. 5D) may be performed in the processes except the plating liquid accumulating process S4.

By repeating the processes shown in FIG. 5A to FIG. 5D, the plating liquid L1 may be repeatedly discharged from the plating liquid nozzle 531. For example, by repeatedly performing the following processing flow, it is possible to continuously perform the plating processing on a plurality of substrates W.

First, the temperature of the plating liquid L1 (hereinafter, also referred to as "first plating liquid L1") for the plating processing on a first substrate W is controlled by the temperature controller 12 (see FIG. 5B). Then, the liquid L51 is supplied to the heat exchanger 13 and the second flow path C2, so that the temperature-controlled first plating liquid L1 is discharged from the plating liquid nozzle 531 to the first substrate W (see FIG. 5C). As such, the plating processing (hereinafter, also referred to as "first plating processing") on the first substrate W is performed using the first plating liquid L1 (see FIG. 5D).

While or after the first plating processing is performed, the plating liquid L1 (hereinafter, also referred to as "second plating liquid L1") for the plating processing on a second substrate W is supplied to the heat exchanger 13 and the second flow path C2 (see FIG. 5B). Thus, the temperature of the second plating liquid L1 is controlled by the temperature controller 12. Also, the liquid L51, which is used for the pushing of the first plating liquid L1 and is remained in the heat exchanger 13 and the second flow path C2, is pushed by the second plating liquid L1 supplied to the heat exchanger 13 and the second flow path C2, and then drained. Then, the liquid L51 is newly supplied to the heat exchanger 13 and the second flow path C2, so that the temperature-controlled second plating liquid L1 is discharged from the plating liquid nozzle 531 and supplied to the second substrate W. As such, the plating processing (hereinafter, also referred to as "second plating processing") on the second substrate W is performed using the second plating liquid L1. By repeating a series of the above-described processes, it is possible to continuously perform the plating processing on the plurality of substrates W.

According to the above-described apparatus and method, after the plating liquid L1 is pushed out, the flow path of the temperature controller 12 is filled with the fluid L5. Thus, it is possible to suppress the plating liquid L1 from being kept in a high temperature state for a long time in the temperature controller 12. Accordingly, it is possible to supply the temperature-controlled plating liquid L1 to the substrate W while suppressing the degradation of the quality of the plating liquid L1. Particularly, even if the same fluid stays inside the temperature controller for a long time when it takes a long time to perform each plating processing, the precipitation of the plating components does not occur. Thus, it is not necessary to perform the cleaning for removing the plating components in the temperature controller 12 and refreshing the plating liquid L1. Also, it is possible to reduce the contamination in the flow path of the temperature controller 12. Thus, it is possible to suppress the inflow of the particles into the plating liquid L1 and reduce the load of maintenance. Further, the strict management of the temperature and the heating time of the temperature controller 12 is not necessarily needed. Thus, it is possible to reduce the load of management.

The process of supplying the plating liquid L1 used for the plating processing into the temperature controller 12 and the process of supplying the fluid L5 for discharging the plating liquid L1 onto the substrate W into the temperature controller 12 are performed separately. Therefore, it is possible to supply the plating liquid L1 into the temperature controller 12 at a desired timing regardless of the time required to perform the plating processing or the status of the plating processing being performed and also possible to heat the plating liquid L1 in the temperature controller 12 for a desired period of time. Accordingly, the heating and the temperature-keeping of the plating liquid L1 by the temperature controller 12 can be optimized. Therefore, it is possible to supply the plating liquid L1 having the optimal temperature without containing the precipitated plating components in the plating processing on the substrate W.

Also, when the plating liquid L1 is pushed from the temperature controller 12 (see FIG. 5C), the gas L52 is interposed between the plating liquid L1 and the liquid L51. Thus, it is possible to suppress the mixing between the plating liquid L1 and the liquid L51. Therefore, it is possible to suppress the degradation of the quality of the plating liquid L1. Further, even when the liquid L51 is pushed from the temperature controller 12 by the plating liquid L1 (see FIG. 5B), the gas L52 may be interposed between the plating liquid L1 and the liquid L51. Thus, it is possible to suppress the mixing between the plating liquid L1 and the liquid L51.

First Modification Example

A plurality of substrates W may be held by a plurality of substrate holders 52, respectively, and the supply of the plating liquid L1 to the temperature controller 12 and the sending of the fluid L5 to the first flow path C1 may be repeated every one or every two or more of the plurality of substrates W. Even in this case, the plating liquid L1 is supplied from the plating liquid sending device 11 to the temperature controller 12 through the first flow path C1, but the plating liquid L1 filled in the temperature controller 12 at one time is used for the plating processing on every one or every two or more substrates W in a repeating unit. Although the fluid L5 is sent from the fluid sending device 16 to the first flow path C1, if the repeating unit includes two or more substrates W, the fluid L5 is intermittently sent to the first flow path C1.

Accordingly, the plating liquid L1 can be discharged to every predetermined number of substrates W. Particularly, by repeating the supply of the plating liquid L1 to the temperature controller 12 and the sending of the fluid L5 to the first flow path C1 for every two or more substrates W, it is possible to efficiently perform the plating processing for the plurality of substrates W. Also, it can be expected that the plating processing will be uniformly performed between two or more substrates W in the repeating unit. For example, the supply of the plating liquid L1 to the temperature controller 12 and the sending of the fluid L5 to the first flow path C1 may be repeated for each of the plurality of substrates W accommodated in the carrier C (see FIG. 1). In this case, it is possible to efficiently perform the plating processing for each carrier C, and, thus, the management thereof is easy.

Second Modification Example

In the example shown in FIG. 3, the device (particularly, the first plating liquid opening/closing valve 24) configured to control the supply of the plating liquid L1 to the temperature controller 12 and the device (particularly, the liquid opening/closing valve 37 and/or the gas opening/closing valve 40) configured to control the supply of the fluid L5 to the temperature controller 12 are provided separately from each other. The controller 3 controls each of these control devices provided on the upstream side of the temperature controller 12 and thus appropriately switches the supply of the plating liquid L1 and the supply of the fluid L5.

These control devices configured to switch the supply of the plating liquid L1 and the supply of the fluid L5 to the temperature controller 12 may be configured by another device and, for example, may be configured by a single device, such as a three-way valve. In this case, the controller 3 can appropriately switch the supply of the plating liquid L1 and the supply of the fluid L5 by controlling the single control device. Also, if the supply of the plating liquid L1 and the supply of the fluid L5 are switched by using the single control device, the single control device may have the functions of the plating liquid constant pressure valve 25 and the liquid constant pressure valve 38 shown in FIG. 3 (see symbol "B" in FIG. 3). In this case, the configuration of the plating liquid supply 53 can be more simplified.

Third Modification Example

In the above-described exemplary embodiments and modification examples, a case where the fluid L5 includes the liquid L51 has been described. However, only the gas L52 may be used as the fluid L5. In this case, the plating liquid L1 can be pushed by the gas L52 like the above-described liquid L51 and a desired amount of the plating liquid L1 can be discharged from the plating liquid nozzle 531 onto the substrate W. The gas L52 has less effect on the plating liquid L1 than the liquid L51 even if the gas L52 comes into contact with the plating liquid L1. Meanwhile, the liquid L51 has a higher cleaning performance than the gas L52. Therefore, it is desirable to selectively use the liquid L51 and the gas L52 depending on the properties of the plating liquid L1 and the device characteristics of the plating liquid supply 53. Particularly, when a combination of the liquid L51 and the gas L52 is used as the fluid L5, it is possible to obtain the beneficial effects of the liquid L51 and the gas L52, respectively.

Other Modification Examples

The present disclosure is not limited to the above-described exemplary embodiments and modification examples, and constituent elements can be modified and changed in an embodiment within the scope of the present disclosure. Further, the constituent elements described in the above exemplary embodiments and modification examples can be combined appropriately to form various apparatuses and methods. Some constituent elements may be removed from all the constituent elements shown in the exemplary embodiments and modification examples. Also, the constituent elements in different exemplary embodiments and modification examples may be combined appropriately.

For example, the present disclosure may be embodied by a recording medium (for example, the recording medium 31) storing therein the program that, when executed by the computer for controlling the operation of the substrate liquid processing apparatus, causes the computer to control the substrate liquid processing apparatus to perform the above-described substrate liquid processing method.

According to the present disclosure, it is possible to supply the temperature-controlled plating liquid to the substrate while suppressing the degradation of the quality the plating liquid

We claim:

1. A substrate liquid processing apparatus configured to supply a plating liquid to a substrate, comprising:

a substrate holder configured to hold the substrate;

a plating liquid sending device configured to send the plating liquid to a first flow path;

a temperature controller connected to the plating liquid sending device via the first flow path and configured to control a temperature of a fluid supplied through the first flow path to a predetermined temperature for plating from a temperature that is not the predetermined temperature for plating;

a pushing fluid sending device configured to send a pushing fluid different from the plating liquid stored in the temperature controller to the first flow path, wherein the first flow path is disposed between the plating liquid sending device and the temperature controller;

a discharge device connected to the temperature controller and configured to discharge a fluid, including the plating liquid or the pushing fluid, supplied from the temperature controller; and a controller configured to control the plating liquid sending device and the pushing fluid sending device such that a timing of sending the plating liquid from the plating liquid sending device to the first flow path to store the plating liquid in the temperature controller is different from a timing of sending the pushing fluid from the pushing fluid sending device to the first flow path to push the plating liquid stored in the temperature controller by the pushing fluid, the controller is further configured to control the plating liquid sending device and the pushing fluid sending device to execute:

a) supplying the plating liquid from the plating liquid sending device to the temperature controller through the first flow path; and b) after a), after the plating liquid has been heated to the predetermined temperature for plating in the temperature controller, pushing the plating liquid in the temperature controller by a sending of the pushing fluid from the pushing fluid sending device to the first flow path, wherein the substrate includes multiple substrates, and a) and b) are repeated for every one of the multiple substrates.

2. The substrate liquid processing apparatus of claim 1, wherein the discharge device discharges the plating liquid sent from the temperature controller as the pushing fluid is sent from the pushing fluid sending device to the first flow path.

3. The substrate liquid processing apparatus of claim 1, wherein the discharge device has an opening through which the fluid is discharged, the discharge device is configured to be moved to be located at a discharge position where the opening faces the substrate held by the substrate holder and a retreat position where the opening does not face the substrate held by the substrate holder, and the discharge device discharges the pushing fluid at the retreat position.

4. The substrate liquid processing apparatus of claim 1, wherein the substrate holder includes multiple substrate holders, and the multiple substrates are held by the multiple substrate holders, respectively.

5. The substrate liquid processing apparatus of claim 1, wherein the pushing fluid includes a pushing liquid.

6. The substrate liquid processing apparatus of claim 5, wherein the pushing fluid includes a pushing gas, and the pushing fluid sending device includes a pushing liquid supply configured to send the pushing liquid to the first flow path and a pushing gas supply configured to send the pushing gas to the first flow path.

7. The substrate liquid processing apparatus of claim 6, wherein the pushing gas is supplied into the temperature controller through the first flow path after the plating liquid is supplied into the temperature controller through the first flow path, and the pushing liquid is supplied into the temperature controller through the first flow path after the pushing gas is supplied into the temperature controller through the first flow path.

8. The substrate liquid processing apparatus of claim 1, further comprising:

a second flow path configured to connect the temperature controller to the discharge device; and a drain flow path connected to the second flow path and configured to drain a fluid including the plating liquid or the pushing fluid inside the second flow path.

* * * * *